United States Patent [19]

Latshaw et al.

[11] Patent Number: 4,606,198

[45] Date of Patent: Aug. 19, 1986

[54] PARALLEL EXPANSION VALVE SYSTEM FOR ENERGY EFFICIENT AIR CONDITIONING SYSTEM

[75] Inventors: Daniel L. Latshaw, Columbus; Stephen C. Sillato, Marietta, both of Ohio

[73] Assignee: Liebert Corporation, Columbus, Ohio

[21] Appl. No.: 704,322

[22] Filed: Feb. 22, 1985

[51] Int. Cl.[4] ..... F25B 41/04

[52] U.S. Cl. ..... 62/205; 62/225

[58] Field of Search ..... 62/228.4, 215, 205, 62/204, 206, 222, 223, 225, 210, 211, 212

[56] References Cited

U.S. PATENT DOCUMENTS

| | | | |
|---|---|---|---|
| 2,112,039 | 3/1938 | McLenegan | 62/225 X |
| 2,379,286 | 6/1945 | Dobson | 62/205 |
| 2,669,849 | 2/1954 | Lange | 62/225 |
| 3,559,422 | 2/1971 | Holzer | 62/215 X |

*Primary Examiner*—Harry Tanner

*Attorney, Agent, or Firm*—Mueller and Smith

[57] ABSTRACT

Disclosed are novel expansion means useful in an air conditioning system of the type having a refrigerant which sequentially flows through variable speed compressor means responsive to varying outdoor air temperature for attenuating refrigerant mass flow corresponding to lower outdoor air temperature and which compresses vaporous refrigerant supplied by evaporator means, condenser means which is in heat exchange relationship with outdoor air for condensing refrigerants circulated from said compressor means, expansion means which expand said liquid refrigerant from said condenser means, and evaporator means which is in direct or indirect heat exchange relationship with air in a confined space for maintaining said confined space air at a desired set point of temperature and/or humidity, said evaporator supplying said refrigerant to said compressor means. The improved expansion means comprises two refrigerant expansion valve means which are connected in parallel by a refrigerant line from said condensing means and which passes said refrigerant to said evaporator means. The secondary valve means is of greater capacity than the primary valve means. Secondary valve means has its equalizing line connected to the refrigerant line between the secondary valve means and the evaporator means.

6 Claims, 5 Drawing Figures

PARALLEL EXPANSION VALVE SYSTEM FOR ENERGY EFFICIENT AIR CONDITIONING SYSTEM

BACKGROUND OF THE INVENTION

The present invention generally relates to air conditioning and refrigeration systems and more particularly to a valving system for an air conditioning system for use in conjunction with interior confined space, which exhibits significantly improved energy efficiency at low outdoor ambient temperatures.

Air conditioning systems comprising a compressor, a condenser, expansion valve(s), and an evaporator associated in a cyclical relationship, have two basic temperature variables placed upon them to which they must respond. One variable is the load placed on the evaporator which piece of equipment is located within a confined space which is to be cooled. The second variable placed upon the air conditioning system is the outdoor ambient temperature to which the condenser is subject. While virtually all air conditioning and refrigeration systems must respond to the same outdoor ambient temperature placed upon the condenser, the evaporator loads may vary drastically depending upon the intended use of the system. For example, refrigeration systems may be utilized for maintaining frozen-food cases in grocery stores wherein extremely low temperature must be maintained, but a substantially constant load is placed upon the evaporator. Another example concerns air conditioning loads placed upon systems designed to maintain the temperature within large buildings. Dramatic temperature differentials between one side of the building facing the sun and the opposing side in the shade cause very great variable loads to be placed upon the evaporator.

Another class of air conditioning systems involves designs structured to maintain specific rooms or sections interiorly located of a building at a substantially constant temperature and humidity. Such systems are required, for example, to maintain proper computer room environments. These systems must be capable of recourse to variable loads placed upon the evaporator to maintain substantially constant temperature and humidity conditions within the enclosed space. While the such loads as are witnessed within computer room environments generally are normally substantially constant, the system must be effectively responsive should variable load conditions be placed upon it.

Regardless of the particular air conditioning or refrigeration system under consideration, its location in regions which are subject to distinct seasonal temperature variations can strain its performance especially during winter months when the condenser is subject to low outdoor ambient temperatures. As the outdoor ambient temperature decreases, a corresponding decrease in the head pressure from the compressor occurs. As the head pressure decreases, an adequate pressure drop across the expansion valving becomes difficult to maintain. A variety of techniques have been proposed to efficiently utilize the cold outdoor temperature in providing additional cooling capacity for air conditioning systems. The state of the art technique from which the present invention has application is described in commonly-assigned application of Sillato and Baer, U.S. Ser. No. 06/565,407, filed Dec. 17, 1983, the disclosure of which is expressly incorporated herein by reference. The Sillato et al. system maintains constant the set point of the temperature and/or humidity of a confined space or body, at variable heat loads therein, while the condenser is subjected to variable condenser temperature, eg. due to variable outdoor air temperature. Improved efficiencies for the system are achieved through the incorporation of variable speed, ie. capacity, compressor means responsive to varying condenser temperature, eg. varying outdoor air temperature, for attenuating liquid refrigerant mass flow during periods of lower outdoor air temperatures; and expansion means which maintain adequate mass flow of refrigerant to the evaporator for maintaining, for example, the desired set point of the temperature and/or humidity of the confined space, throughout the varying outdoor air temperatures. The energy efficiency ratio of the Sillato et al. system is improved as successively lower outdoor ambient air temperatures, ie. condenser temperatures, are witnessed.

BROAD STATEMENT OF THE INVENTION

The present invention most advantageously is the integrally-related expansion means called for in the Sillato et al. energy efficient air conditioning system. Such system is an air-conditioning system of the type having a refrigerant which sequentially flows through variable speed compressor means responsive to varying outdoor air temperature for attenuating refrigerant mass flow corresponding to lower outdoor air temperature and which compresses vaporous refrigerant supplied by evaporator means, condenser means which is in heat exchange relationship with outdoor air condensing refrigerant circulated from said compressor means, expansion means which expands said liquid refrigerant from said condenser means, and evaporator means which is in direct or indirect heat exchange relationship with air in a confined space for maintaining said confined space air at a desired set point of temperature and/or humidity, said evaporator supplying said refrigerant to said compressor means. The expansion means are responsive to attenuated refrigerant mass flow for maintaining adequate refrigerant mass flow to the evaporator means in an adequate pressure drop said expansion means for maintaining constant the desired set point of temperature and/or humidity of the confined space at varying outdoor air temperature and comprises two refrigerant expansion valve means which are connected in parallel by a refrigerant line from said condensing means and which passes said refrigerant to said evaporator means. The secondary valve means is of greater capacity than the primary valve means. The secondary valve means has its equalizing line (external or internal) connected to the refrigerant line between the secondary valve means and the evaporator means.

The self-controlled parallel valving configuration of the present invention additionally is useful for maintaining a set point of a body which expresses a heat load, which body may be a confined space which requires conditioning of air therein. Another aspect of the invention resides in the method for using the above-described valving configuration in an air conditioning system for maintaining constant the set point conditions of the confined space.

Advantages of the present invention include the ability to maintain adequate mass flow of refrigerant to the evaporator and an adequate pressure drop across the expansion means at widely varying head pressures in the air conditioning system. Another advantage is the ability of the unique parallel valving configuration to be self-actuating in maintaining the refrigerant mass flow and pressure drop thereacross. These and other advantages will be readily apparent to those skilled in the art based upon the disclosure contained herein.

Figure 1:
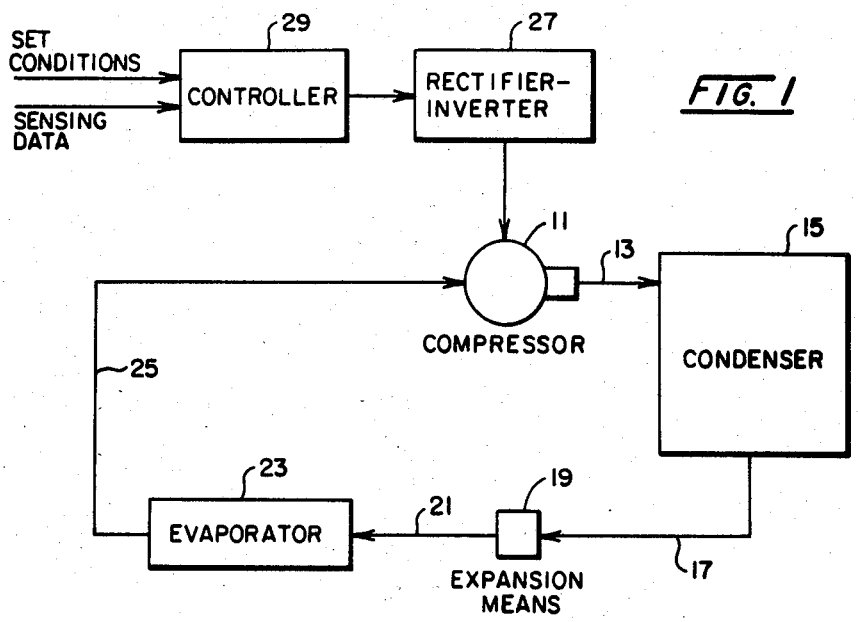
FIG. 1 is a flow diagram of an air conditioning system suitable for employing the unique parallel valve configuration of the present invention.

These drawings will be described in detail below.

DETAILED DESCRIPTION OF THE INVENTION

The Sillato et al. system is addressed to a substantial need in industry for an air conditioning and/or refrigeration system which takes advantage of decreasing outdoor air temperatures to significantly improve the energy efficiency ratio of the system without placing an undue strain on any of the equipment of which it is comprised. Such accomplishment is achieved through a unique combination of equipment which includes a variable speed compressor which is responsive to indoor load and outdoor air temperature. The variable speed compressor is combined with expansion means which maintains an adequate mass flow to the evaporator, thus maintaining the desired temperature of the air or other fluid in the heat exchanging relationship. The present invention is directed to a unique multiple valve arrangement for accomplishing such purpose.

For a proper understanding of the unique multiple valve configuration of the present invention, an appreciation of the underlying theory of performance of the Sillato et al. system is required. In this regard, reference is made to FIG. 1 which illustrates the basic components of the system, showing interconnection of these components. Set conditions or set point conditions can include a desired temperature and/or humidity (or range thereof) for the confined space treated by the system. These conditions and data are fed into controller 29 which monitors and controls rectifier-inverter 27. The air conditioning system comprises primarily compressor 11 which compresses a vaporous refrigerant to a higher pressure state which pressurized refrigerant flows from compressor 11 through line 13 to condenser 15. Condenser 15 is located outdoors in heat exchanging relationship with the outdoor air and thus is subject to influence of ambient air temperatures. Condenser 15 causes the refrigerant from compressor 11 to condense to its liquid phase with corresponding heat removal being provided typically to the outdoor air by means of heat exchanging fins or other conventional heat-exchanging surfaces typically having outdoor air blown across such surfaces; although a variety of additional arrangements known in the art are practical (eg. water, glycol, or other fluid cooled condensers). Condensed refrigerant from condenser 15 flows through line 17 and into expansion means 19 which typically has been a thermostatic expansion valve. The pressure of the refrigerant exiting compressor 11 and entering expansion means 19 is known as the "head pressure" in the art and is substantially the same pressure throughout this portion of the air conditioning circuit. Pressure of the refrigerant exiting expansion means 19 in line 21 is dropped and the lower pressure mass flow of refrigerant into evaporator 23 causes a substantial amount of heat to be absorbed by the refrigerant.

A conventional evaporator has a fan or other arrangement which blows air across the evaporator heat exchanging surface for cooling and/or dehumidifying purposes. Such flow of treated cold air typically is used for cooling a confined indoor space, for example a computer room. Cooling of the air by its flow across the evaporator is termed "direct" heat transfer for present purposes. "Indirect" heat transfer employs the cooling of an intermediate fluid (eg. water, water/glycol mixture, etc.) which cooled fluid then is contacted with the air of the confined space for its conditioning (eg. temperature and/or humidity). In fact, such cooled fluid may be used directly to cool a mainframe computer, eg. by circulating the cooled fluid through the computer to absorb or dissipate heat generated by the components therein. It may be desirable to flow the refrigerant directly through the computer so that the computer (or its components) becomes the evaporator in the system. The refrigerant in its vaporous state is withdrawn from evaporator 23 and passed by line 25 for return to compressor 11. This portion of the air conditioning circuit is known as the "suction line" having a "suction pressure" in line 25 and will be referred to as such herein. Of course variable air flow across the evaporator means (or flow of other fluid therethrough for its cooling) due to variable and varying heat loads may be practiced in conventional fashion as is necessary, desirable, or convenient.

With respect to the components depicted in FIG. 1, it should be understood that a variety of arrangements thereof may be provided, for instance, in parallel, cascade, series, or additional configurations while still retaining the precepts of the present invention. That is, use of multiple compressors for achieving the variable mass flow may be desirable on occasion, but certainly is not preferred. Further, multiple condensers and/or evaporators may find utility in accordance with generally accepted practices within the air conditioning industry. The same is true with respect to a single compressor which is "variable speed". Such terminology comprehends a compressor which may be "continuously" increased or decreased in capacity or one which "stepwise" may be increased or decreased in capacity. Whether the compressor speed, and hence the refrigerant mass flow rate, is achieved via a variable capacity compressor or an inverter is not critical for the present invention to properly function, it only being necessary that the capacity of the compressor may be varied for attenuating refrigerant mass flow corresponding to lower outdoor temperatures experienced by the condenser. Thus, means for varying the speed of the compressor may include a variety of known mechanical and/or electrical and/or electronic devices as may be necessary, desirable, or convenient to the designer. It also should be recognized that the use of pumps, surge tanks, and like equipment may find use on occasion to augment or otherwise achieve special effects on various of the refrigerant flow lines depicted in FIG. 1. So long as the air conditioning (or refrigeration) system functions to attenuate refrigerant mass flow responsive to outdoor air temperature at the condenser with concomitant control of refrigerant mass flow to the evaporator by expansion means, such system is within the precepts taught herein.

In this latter regard, it should be understood that varying outdoor air temperature at the condenser may be simulated or achieved when various process cooling fluids of varying temperature are used in the condenser to condense the refrigerant. Such temperature-varying process fluids may express temperature profiles independent of seasonal temperature variations. The remaining refrigeration circuit, however, only responds to the condensing temperature variations, and not to the cause of such variations. Thus, it will be apparent that the novel air conditioning/refrigeration system will function equally effectively responsive to variable condensing temperature regardless of the phenomenon which causes such variable condensing temperature.

Refrigerant flow in the system, eg. from condenser 15 through expansion means 19 and into evaporator 23, it not constrained to be all liquid or to be a predetermined ratio of liquid to gaseous refrigerant. The present system operates with whatever liquid or liquid/gaseous phase mixtures of refrigerant occur by virtue of control and operation of the system as described herein, i.e. varying the compressor speed and expansion means mass flow responsive to the outside air temperature (load) on condenser 15 and the indoor heat load on evaporator 23. In this connection, it should be apparent that virtually any conventional refrigerant, eg. various Freons, may be used to advantage in the present system.

Figure 2:
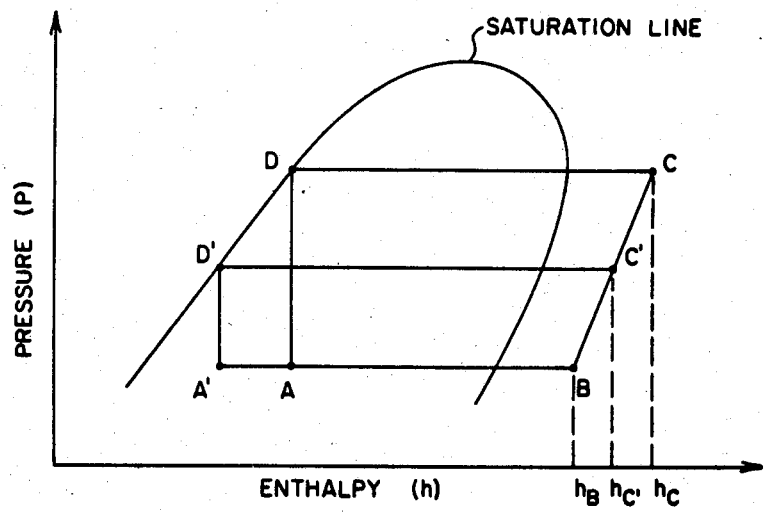
FIG. 2 is a pressure-enthalpy diagram of the air conditioning system of FIG. 1.

Referring to FIG. 2 which displays a conventional pressure-enthalpy diagram, the air conditioning system in FIG. 1 operating during normal summer seasonal conditions can be represented by lines ABCD. Segment BC of the cycle represents the function of compressor 11 wherein the pressure of the refrigerant is increased. The function of condenser 15 is represented by segment CD of the thermodynamic cycle in FIG. 2 and results in a decrease in the enthalpy of the refrigerant to a point on the saturation line corresponding with the particular refrigerant being used in the circuit. Expansion means 19 results in a pressure drop of the refrigerant as represented by segment DA. Finally, the refrigerant's transformation from its liquid phase to its vaporous phase in evaporator 23 results in an increase in the enthalpy of the refrigerant as represented by segment AB of the thermodynamic curve in FIG. 2.

During winter time operation, however, the head pressure drops due to the influence of colder outdoor air temperatures on condenser 15. Expansion means are designed for minimum pressure drops for proper operation. If the head pressure is not maintained sufficiently high for the particular evaporator in the circuit, the expansion means and evaporator will no longer function properly and room cooling will decrease. With lower head pressure for efficiency of compressor 11 will increase dramatically. The Sillato et al. system utilizes such increased compressor efficiency for a positive benefit in the overall system as will be more fully explained below. Another problem associated with colder outdoor air temperatures is the ability of expansion means 19, typically a thermal expansion valve, to allow the proper mass flow through evaporator 23 due to the dropping head pressure introduced to it. Conventional air conditioning valves are designed for specific pressure drops thereacross. Unfortunately, such valves cannot fully accommodate for all head pressure conditions which normally are associated with an outdoor-located condenser 15 for proper mass flow control of refrigerant to evaporator 23.

The Sillato et al. system, then, operates its thermodynamic cycle in winter following the thermodynamic cycle along lines BC'D'A' as set forth in FIG. 2. This operation is predicated upon a reduction in mass flow of refrigerant in the system which is developed at compressor 11 by rectifier-inverter 27 and associated controller 29. With reduced mass flow and properly designed expansion means 19 to accommodate the resulting lower head pressures experienced during winter time operation, the performance of compressor 11 is represented along segment BC' wherein the pressure of the refrigerant is increased, though not nearly as much as is required during summertime operation. The corresponding functioning of condenser 15 results in a decrease in enthalpy of the refrigerant as expressed by segment C'D'. Expansion means 19 functions to derive a pressure drop of the refrigerant as expressed by segment D'A'. This pressure drop also is less than the pressure drop experienced during summertime operation; however, the corresponding increase in enthalpy, or cooling capacity, of the refrigerant in evaporator 23 is expressed by segment A'A. The enthalpy difference along segment A'B is more than the corresponding difference increase along segment AB. This phenomena demonstrates the increased cooling capacity of evaporator 23 during lower head pressure performance, ie. winter, operating conditions. Of course, the amount of enthalpy gained by operation of the Sillato et al. system is represented by the difference in enthalpy between summer and winter operation, ie. the difference between point A' and point A, and the energy (or enthalpy) input to the compressor saved is the difference in enthalpy between point C' and C (i.e. $h_c - h_{c'}$). For a given mass flow rate of refrigerant in the system, the energy saved is a product of such mass flow rate times the difference in seasonal enthalpy values. The magnitude of such energy savings will be fully appreciated by reference to the Example which will be set forth below.

Expansion means are suitable for use in the Sillato et al. system by permitting the refrigerant of choice to expand and, thus, effect a cooling by the evaporator. Conventional systems employ expansion means which, if subjected to variable mass flow, would be incapable of maintaining a desired superheat or suction gas temperature. Such superheat gas temperature rise would mean less cooling was occurring and would necessitate a condition change be introduced into the system, eg. a lower evaporator capacity, increased compressor speed, etc. Such conditions, though, would require energy input to the system which would lessen the basic energy saving advantage of the system. Thus, with variable speed or capacity compressor means, the expansion means must be designed for and capable of functioning under attenuated mass flow conditions and result in energy savings at any given set point conditions which are maintained.

Figure 3:
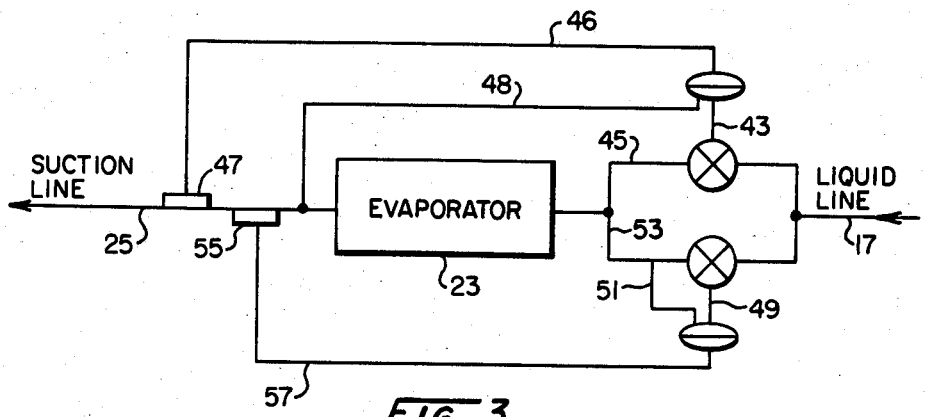
FIG. 3 is a detailed flow diagram of the parallel valving configuration of the invention as would be implemented in the flow diagram of FIG. 1 as expansion means 19.

The unique valving arrangement in FIG. 3 is designed for performance during normal summer time operation wherein high head pressures are experienced. Under these conditions control is exercised by thermal expansion valve 43 which is conventional in size and is connected via line 45 to evaporator 23. Expansion valve 43 is a conventional thermostatic expansion valve which responds to thermal sensor 47 and has its external equalizer line 48 coupled for response to pressure at suction line 25. Expansion valve 49, which is larger (greater capacity) than expansion valve 43, does not operate during normal high head pressure conditions. During winter time operations when the head pressure in line 17 decreases, thermal expansion valve 43 will open wide and no longer provide control of superheat for evaporator 23. Accordingly, oversized thermal expansion valve 49, having equalizing line 51 connected to its output line 53, has sufficient capacity for providing the desired superheat for evaporator 23. Thermal expansion valve 49 is connected to sensor 55 at suction line 25 in conventional fashion.

Figure 4:
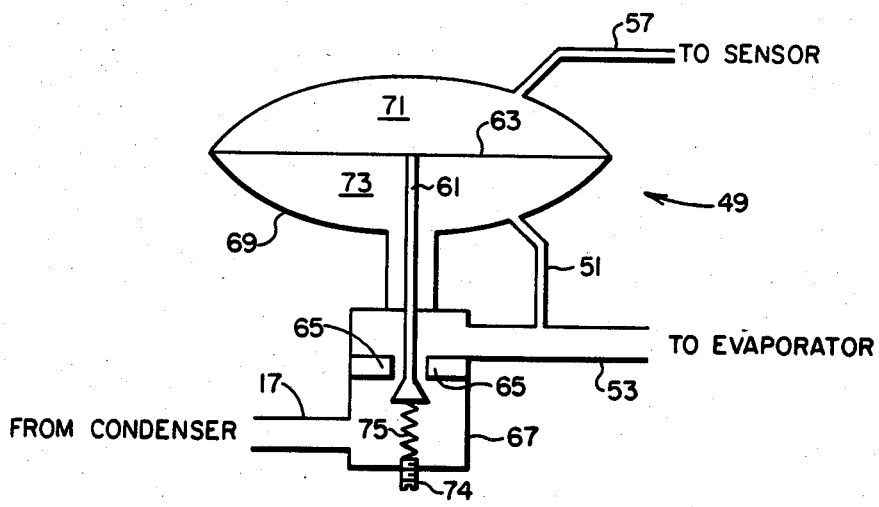
FIG. 4 is a simplified cross-section elevational view through valve 49 of FIG. 3.

The uniqueness of the placement of equalizing line 51 of valve 49 can be seen by reference to FIG. 4. FIG. 4 is a cross section elevational view through valve 49 in simplified form. The amount of opening of valve 49 is dependent upon the position of rod 61 which, in turn, is controlled by diaphragm 63. The lower end of rod 61 moves into and out of the passageway formed by flow restriction member 65 and, thus, controls the amount of refrigerant flow through line 17 from the condenser to line 53 to evaporator 23. Flow restriction member 65 and the lower end of rod 61 are contained in housing 67 which is sealed from section 69 which contains diaphragm 63. The position of rod 61 is determined by the position of diaphragm 63. The position of diaphragm 63 is controlled by three forces. In upper chamber 71 the force is created by the pressure of refrigerant due to the temperature in the suction line. Line 57 is in communication with sensor 55 which is a sensor filled with an appropriate gas and/or liquid and which sensor is in heat exchanging relationship with suction line 25. Such heat exchange relationship means that the temperature and the pressure of the gas and/or liquid in sensor 55 is about the same as the temperature and pressure of the refrigerant in suction line 25. In chamber 73 is the pressure of the refrigerant in line 53 which is communicated to chamber 73 via external equalizing line 51. The third force is provided by adjustment spring 75 which typically is used to change the superheat temperature, if desired or necessary. Typically, the valve is stable when the forces are in balance as follows:

$$F_{spring\ 75}+F_{73}=F_{71}.$$

As to operation of expansion valve 49, the pressure exerted by spring 75 is adjusted to maintain the superheat at sensor 55 in accordance with the force balance set forth above. The superheat temperature for most air conditioning applications ranges from between about 5.55° to 8.33° C. (10°–15° F.) above the evaporator temperature depending upon refrigerant type and other factors well known in the art. Preceding evaporator 23 in most commercial air conditioning systems is a distributor and a multiplicity of feed tubes. The distributor and feed tubes typically are sized for a desired pressure drop at full load and maximum design head pressure (e.g. 10–35 psig pressure drop for Freon brand halogenated hydrocarbon refrigerant such as R-22, monochlorodifluoro methane). This means that at full load and design head pressure (e.g. summertime operation), the force in equalizing line 51 of secondary valve 49 will be 10–35 psig (for Freon brand halogenated hydrocarbon refrigerant such as R-22, monochlorodifluoro methane) higher than normally connected primary valve 43 which has its external equalizing line connected to suction line 25 and its bulb line 46 connected to sensor 47. The additional force added by equalizing line 51 will overcome the bulb force communicated by line 57 to chamber 71 and, therefore, close valve 49. Note that this effect also could be accomplished by increasing the force of spring 76 with adjustment knob 74 if there was no distributor or feed tubes to impart such larger pressure drop. It should be understood that normally there will be some pressure drop into the evaporator, typically 2–6 psig, even if there is no distributor. Thus, under high head pressure operations, primary valve 43 controls the mass flow of refrigerant and pressure of refrigerant to evaporator 23.

During partial load conditions (e.g. winter time operations), the pressure in line 53 to evaporator 23 will be much lower as the head pressure and suction line pressure tend to merge. As the pressure or force exerted through equalizing 51 decreases, secondary valve 49 will commence opening in order to maintain an adequate mass flow of refrigerant required in the overall system due to the lower head pressures being experienced. Under such partial load conditions, primary valve 43 can be in a wide open position and secondary valve 49 would control the mass flow and pressure drop required of the expansion means in the air conditioning system.

The placement of equalizing line 51 to sense valve 49's own output pressure is the unique self-regulating or controlling feature of the valve configuration. That is, no temperature or pressure sensors to line 17 from condenser 15 are required for operation of the parallel valve configuration of the present invention. The valving configuration, then, is "automatic" or self-controlling. Important in this regard additionally is the requirement for valve 49 to be much greater in capacity than valve 43. The desirable ratio of capacity is about 4:1 for the air conditioning system depicted in the examples. It should be noted in this regard that a design criteria of 10 psi pressure drop minimum has been placed on the valves as an operating safety criteria, though such figure could be lower if desired.

The use of the unique parallel valving configuration of the present invention is the energy efficiency air conditioning system of Sillato et al. is illustrated by reference to the following example which shows how the invention has been practiced, but should not be construed as limiting.

EXAMPLE

A laboratory air conditioning system like that depicted in FIG. 1 and containing the parallel valving arrangement of FIG. 3 was evaluated in a laboratory environmental chamber. The compressor was a positive displacement piston-type of 31.3 cu. ft./min. at 1750 rpm; the condensor had a total heat of rejection capacity of 86,000 BTU/hr at 25° F. (difference between condensing temperature and ambient); the two thermal expansion valves had a capacity of 5 tons and 20 tons; and the evaporator had a cooling capacity of 60,000 BTU/hr. with a 2,634 CFM rated blower.

The condenser was subjected to various air temperatures to simulate varying seasonal outdoor air temperatures and the compressor speed attenuated in response thereto for maintaining the laboratory environmental room air temperature at 74°–75° F. At condenser air temperatures ranging from about 100° F. to 32° F., the confined air space dry bulb temperature actually ranged from 73.9° to 75.4° F. (wet bulb temperature range of 60.8° F. to 61.3° F.).

Two load conditions were evaluated. Full load comprised an electric resistance heater of 54.267 BTU (15.9 KW load) and half load (actually 52% load) of 25.939 BTU (7.6 KW load). The evaporator fan motor provided an additional 4,608 BTU (1.37 KW) of heat load for each test for a total "100% load" test of 58,875 BTU and a "52% load" test of 30,547 BTU.

For each load condition, the energy input to the compressor was recorded so that the energy efficiency ratio (EER) could be calculated, i.e. ratio of heat load to compressor energy input expressed as BTU/watt. The following results were recorded.

TABLE 1

| Outdoor Ambient Temp. (°F.) | Energy Input to Compressor (Watt) | EER (BTU/watt) |
|---|---|---|
| 100% Load = 58,875 BTU | | |
| 95 | 5340 | 11.0 |
| 88 | 4440 | 13.3 |
| 76 | 3420 | 17.2 |
| 66 | 2700 | 21.8 |
| 58 | 2100 | 28.0 |
| 46 | 1380 | 42.7 |
| 36 | 1080 | 54.5 |
| 32 | 900 | 65.4 |
| 52% Load = 30,547 BTU | | |
| 98 | 1920 | 15.9 |
| 87 | 1560 | 19.6 |
| 78 | 1140 | 26.8 |
| 67 | 780 | 39.2 |
| 56 | 600 | 50.9 |
| 49 | 420 | 72.7 |

Figure 5:
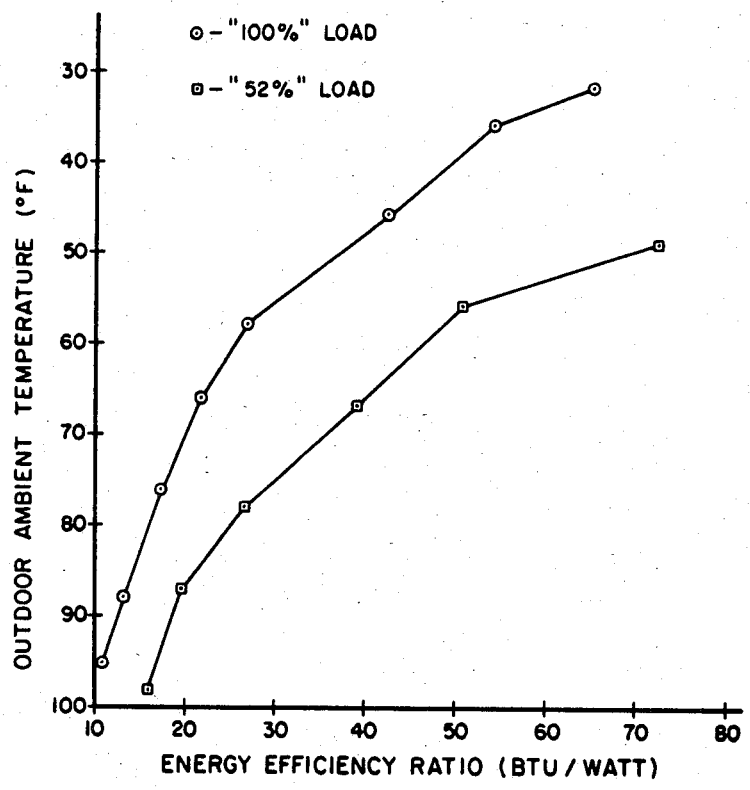
FIG. 5 depicts graphically the Energy Efficiency Ratio (BTU/watt) versus outdoor ambient air temperature obtained in actual operation of an air conditioning system embodying the unique valving configuration of the present invention.

The above-tabulated data is depicted graphically in FIG. 5. These data demonstrate the improved energy efficiencies which the present invention provdes while maintaining desired set point conditions of the confined space.

We claim:

1. An improved air conditioning system of the type having a refrigerant which sequentially flows through variable speed compressor means responsive to varying outdoor air temperature for attenuating refrigerant mass flow corresponding to lower outdoor air temperature and which compresses vaporous refrigerant supplied by evaporator means, condenser means which is in heat exchange relationship with outdoor air for condensing refrigerant circulated from said condenser means, expansion means which expands said liquid refrigerant from said condenser means, and evaporator means which is in direct or indirect heat exchange relationship with air in a confined space for maintaining said confined space air at a desired set point of temperature and/or humidity, said evaporator supplying said refrigerant to said compressor means, the improvement which comprises said expansion means comprising two refrigerant expansion valve means which are connected in parallel by a refrigerant line from said condenser means and which passes said refrigerant to said evaporator means, the secondary valve means being of greater capacity than the primary valve means, said primary refrigerant expansion valve means having its equalizing line connected to the refrigerant line exiting said evaporator, said secondary valve means its equalizing line connected to the refrigerant line between said secondary valve means and said evaporator means, said two refrigerant expansion valve means being responsive to attenuated refrigerant mass flow for maintaining adequate refrigerant mass flow to the evaporator means and an adequate pressure drop across said expansion means for maintaining constant the desired set point of temperature and/or humidity of the confined space at varying outdoor air temperature.

2. The air conditioning system of claim 1 wherein the capacity of said secondary valve means is about four times greater than the capacity of said primary valve means.

3. The air conditioning system of claim 1 wherein said refrigerant comprises a halogenated hydrocarbon refrigerant.

4. In a method for maintaining a confined space at a desired set point of temperature and/or humidity by conditioning air in said space with an air conditioning system of the type having a refrigerant which sequentially flows through variable speed compressor means which varies the mass flow of the refrigerant responsive to varying outdoor air temperature wherein the flow of refrigerant is attenuated at lower outdoor air temperature, condenser means located outdoors, expansion means, and indoor evaporator means which is in direct or indirect heat exchange relationship with said space air, the improvement which comprises maintaining an adequate mass flow of refrigerant from said expansion means to said evaporator means and adequate pressure drop across said expansion means with two refrigerant expansion valve means which are connected in parallel by a refrigerant line from said condensing means and which passes said refrigerant to said evaporator means, secondary valve means being of greater capacity than the primary valve means, said primary refrigerant expansion valve means having its equalizing line connected to the refrigerant line exiting said evaporator, said secondary valve means having its equalizing line connected to the refrigerant line between said secondary valve means and said evaporator means.

5. The method of claim 4 wherein the capacity of said secondary valve means is about four times greater than the capacity of said primary valve means.

6. The method of claim 4 wherein said refrigerant flowing through said air conditioning system comprises a halogenated hydrocarbon refrigerant.

* * * * *